US007689141B2

(12) United States Patent
Lenahan et al.

(10) Patent No.: US 7,689,141 B2
(45) Date of Patent: Mar. 30, 2010

(54) LASER PRINTER TONER CARTRIDGE SEAL AND METHOD

(75) Inventors: Scott Lenahan, Castaic, CA (US); Oswaldo Cota, Palmdale, CA (US); Jesus Gonzalez Perez, Chatsworth, CA (US)

(73) Assignee: Wazana Brothers International, Inc., Van Nuys, CA (US)

( * ) Notice: Subject to any disclaimer, the term of this patent is extended or adjusted under 35 U.S.C. 154(b) by 373 days.

(21) Appl. No.: 11/925,751

(22) Filed: Oct. 27, 2007

(65) Prior Publication Data

US 2009/0110431 A1 Apr. 30, 2009

(51) Int. Cl.
*G03G 15/08* (2006.01)

(52) U.S. Cl. ..... 399/106; 399/109; 399/113

(58) Field of Classification Search ..... 399/102, 399/103, 105, 106, 107, 109, 111, 113, 262
See application file for complete search history.

(56) References Cited

U.S. PATENT DOCUMENTS 5,621,508 A 4/1997 McNamara
5,634,175 A 5/1997 Michlin et al.
6,801,733 B2 10/2004 Daniels et al.
6,842,595 B1 1/2005 McIver et al.
6,882,810 B2 4/2005 Karagiannis et al.
7,076,186 B1 * 7/2006 Michlin et al. ..... 399/106
7,197,260 B2 3/2007 Jones et al.
7,212,765 B2 5/2007 Lewis et al.

* cited by examiner

*Primary Examiner*—Hoan H Tran

(57) ABSTRACT

A reassembled laser printer toner cartridge and method of manufacture including a cartridge seal assembly in which the remains of an OEM laser printer toner cartridge's toner hopper pull seal strip(s) is left in position, or a substitute conductive strip is put in the same position to simulate the OEM pull seal strip(s) if the OEM strips have been damaged or are missing in order to enable a repaired or remanufactured cartridge to cooperate with the printer in detecting measuring and displaying the amount of toner consumed from the cartridge and shut the printer down, once the toner cartridge is empty, and a toner cartridge hopper foam seal strip assembly that covers the remnants of the OEM seal strips and provides a seal to prevent leakage of toner from the re-filled toner cartridge.

3 Claims, 10 Drawing Sheets

PRIOR ART

LASER PRINTER TONER CARTRIDGE SEAL AND METHOD

FIELD OF INVENTION

The invention relates generally to the field of toner cartridges used in laser printers.

BACKGROUND OF INVENTION

The present invention relates to improvements in the field of laser printer toner cartridge repair and remanufacture. Laser printer toner cartridges are manufactured to a high degree of precision, which precision is needed for proper operation and production of good printed image quality. With respect to some models of toner cartridges used in laser printers, original equipment manufacturers (OEM) include in the original cartridges structures and circuits that can detect the level of remaining toner. These structures typically include electrically conductive strips that function to conduct electrical signals from the cartridge hopper section of the cartridge regarding the level of remaining toner. When the OEM cartridges are repaired or remanufactured, the best known, if not only known way to assure that the laser printer will measure the toner level, and shut off automatically when the toner cartridge is empty is to leave the OEM toner supply tank electrically conductive seal strips in place. When the electrically charged strips, typically two in number, on either side of the open hopper tank are left in place, after the toner is replaced, these strips can trigger the printer's ability to stop printing when the hopper tank is empty of the replacement toner. However, such a process has its own set of problems, including problems relating to poor sealing of the cartridge after repair and until it has been installed in a printer, and problems associate with damage to the OEM strips. Thus, a need exists for structures and methods that can be used to repair or re-manufacture spent toner cartridges so that when refilled with toner, they are capable of operating to the same level of quality as a new, OEM cartridge.

SUMMARY OF INVENTION

The presently described cartridge seals and methods of use overcome the drawbacks known in this field by providing structures and methods for resealing a toner cartridge in a way that preserves the ability for detection and measurement of the toner remaining in the cartridge.

The presently described cartridge seal assemblies, components and methods provide improved operational performance of repaired or remanufactured laser printer toner cartridges. These cartridges have been recycled or remanufactured from components of depleted toner cartridges.

During operation of an original OEM laser printer, and after its toner cartridge hopper tank seal has been pulled, the tank would communicate with the printer to indicate a toner low or out of toner condition through sensors and an electrically conductive path that included conductive strips and contacts on the hopper tank. The signals generated and communicated in this way would function to indicate the amount of toner remaining in the tank, and to automatically shut the printer off when the toner cartridge is empty. During a repair or remanufacturing operation, if the remnants of the OEM toner hopper tank seal electrically conductive strips were removed or damaged, the printer would not function properly when the repaired or remanufactured cartridge was installed in a printer. Specifically, the repaired cartridge would not be able to communicate the status of the toner supply inside the toner hopper tank and would not be able to shut down automatically. Without this communication, the end user would not know how many pages the cartridge had left before the cartridge would be empty.

To keep the remanufactured toner cartridge running as was originally designed, it has been discovered that either the original OEM electrical continuity strips or remnants of those strips have to be used or a replacement, alternate strip must be used in its place. In accordance with the present hopper seal assembly the goal of retaining the original functionality of the cartridge is accomplished by modifying the cartridge to accommodate remnants of the original conductive strips or a replacement conductive strip. If the original OEM electrically conductive strips are missing or are damaged, a custom contact strip is fabricated in accordance with the present seal assembly, and substituted for the original electrically strip(s). This custom strip is preferably used to assure that the printer will show toner low conditions and will shut the printer off automatically when the cartridge is out of toner. As such the presently described novel seal assembly permits the remnant OEM or custom strips to bring a laser toner cartridge back to its original equipment manufacture (OEM) specifications, and to its intended full operational capabilities.

When repairing or remanufacturing this cartridge and either reusing the original OEM continuity strips or using alternate, replacement continuity strips, a novel and special seal is positioned over these strips and functions to form a seal that retains the strips in proper alignment and prevents leakage of toner from this region of the cartridge. The remnants of the original OEM continuity strips typically are loosely placed on the surface of the cartridge hopper section, as is the presently described alternate, replacement continuity strip. In order to keep these continuity strips in proper alignment so that they will function properly for conducting electrical signals, the novel, foam seal is placed over these strips. The seal also prevents leakage during operation of the cartridge. This seal also functions to seal the cartridge during transportation and storage, prior to use by the end user.

Specifically, during initial operation of the OEM cartridge and after the printer has pulled the original OEM toner hopper supply tank seal, typically two electrically conductive continuity strips remain on the surface of the hopper section of the cartridge. These remaining OEM strips function in conjunction with electrical contacts on the cartridge and that are part of an electrically conductive signal path to the printer. The signals generated are used to detect how much toner is left in the cartridge toner hopper tank. These strips are electrically charged when sensing the amount of toner used in the toner cartridge. When the toner has been exhausted from the cartridge toner hopper, the laser cartridge will communicate that condition to the printer and will cause the printer to shut off.

If the strips are removed, in order to better seal the hopper tank when remanufacturing the cartridge, it is found that the printer can not communicate the amount of toner that is left in the hopper tank on a consistent basis, and will not shut the printer off when the toner hopper tank is empty.

An example of this is the fact that if a laser toner cartridge installed in a printer starts to run low of toner, the printer will not give any indication to that fact, consequently, the pages will start to print very lightly, and in time will show nothing, and the printer will keep printing until manually stopped.

With the OEM seal, the printer will show the operator how much toner is left in the cartridge and if left unattended, will shut off automatically. The problem of monitoring the toner load in the hopper tank can be eliminated, by leaving the two remaining OEM pull seal strips in place, or by installing an alternate custom continuity strip. Because the two remaining OEM or alternate pull seal strips are loosely attached to the upper face of the hopper tank, a specially fabricated hopper pull seal assembly had to be designed in order to seal the toner hopper tank when the cartridge is being shipped. This same seal assembly will seal the cartridge while the cartridge is being run in the printer. What is particularly advantageous about this novel seal assembly is its layer of foam-backed adhesive that covers the loose, original OEM conductive strips and also seal the toner hopper tank to prevent toner leakage during shipping as well as during printer operation. Another unique and advantageous feature of the present seal assembly is a rigid, 10-mil piece of acrylic sheet that function as a rigid platform to which the toner hopper pull seal strip can be attached. The pull seal strip functions to seal the toner hopper against toner leakage while the cartridge is being shipped.

Once in the end user's possession, and after the cartridge is placed into the printer, the replacement toner hopper pull seal will be pulled away from the toner cartridge hopper, leaving an opening from which the toner will be released and used for printing pages in accordance with normal printer operation.

The novel hopper pull seal assembly herein also has contact material in the form of a plate or bridge and that functions to electrically connect to the OEM seal strip as well as connect to the electrical contact points on the laser toner cartridge. As such they function to complete the original circuit in the original OEM laser printer toner cartridge, and this in turn results in providing an electrically conductive path to establish communication between the toner cartridge and the printer. Thus, the novel hopper seal assembly, embodiments of which are described in greater detail herein, return the repaired laser toner cartridge to a condition in which the full OEM functions are available during operation of the printer.

It is a primary object of the presently described seal assemblies and methods to provide a means by which a laser printer can detect and determine the amount of toner that is left in the laser printer toner cartridge, can shut down the printer when the toner cartridge has depleted its toner, and can give a warning that the cartridge is low on toner.

These and other embodiments, features, aspects, and advantages of the invention will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

Reference symbols or names are used in the Figures to indicate certain components, aspects or features shown therein. Reference symbols common to more than one Figure indicate like components, aspects or features shown therein.

DETAILED DESCRIPTION

To illustrate and further describe the embodiments of the present seal and method, reference will be made to FIGS. 1-9. Preferably in repairing or remanufacturing a spent laser printer toner cartridge the remaining OEM toner cartridge hopper section electrical continuity strips are left on the cartridge. In instances where the OEM strips are damaged or missing, an alternate or substituted strip made in accordance with the present specification is used to replace the OEM electrical continuity strips. In either instance, seal strips as presently described are then provided on the cartridge and function to seal the cartridge to these continuity strips and to prevent toner from leaking from this area of the printer. The seal strip is referred to a toner hopper pull seal strip, and is part of an assembly that functions to seal the toner hopper and the remnants of the OEM strip or the alternate, substitute continuity strip(s). As such the pull seal assembly functions to keep the laser printer toner cartridge from leaking toner during both shipping and use inside of the printer.

Figure 1A:
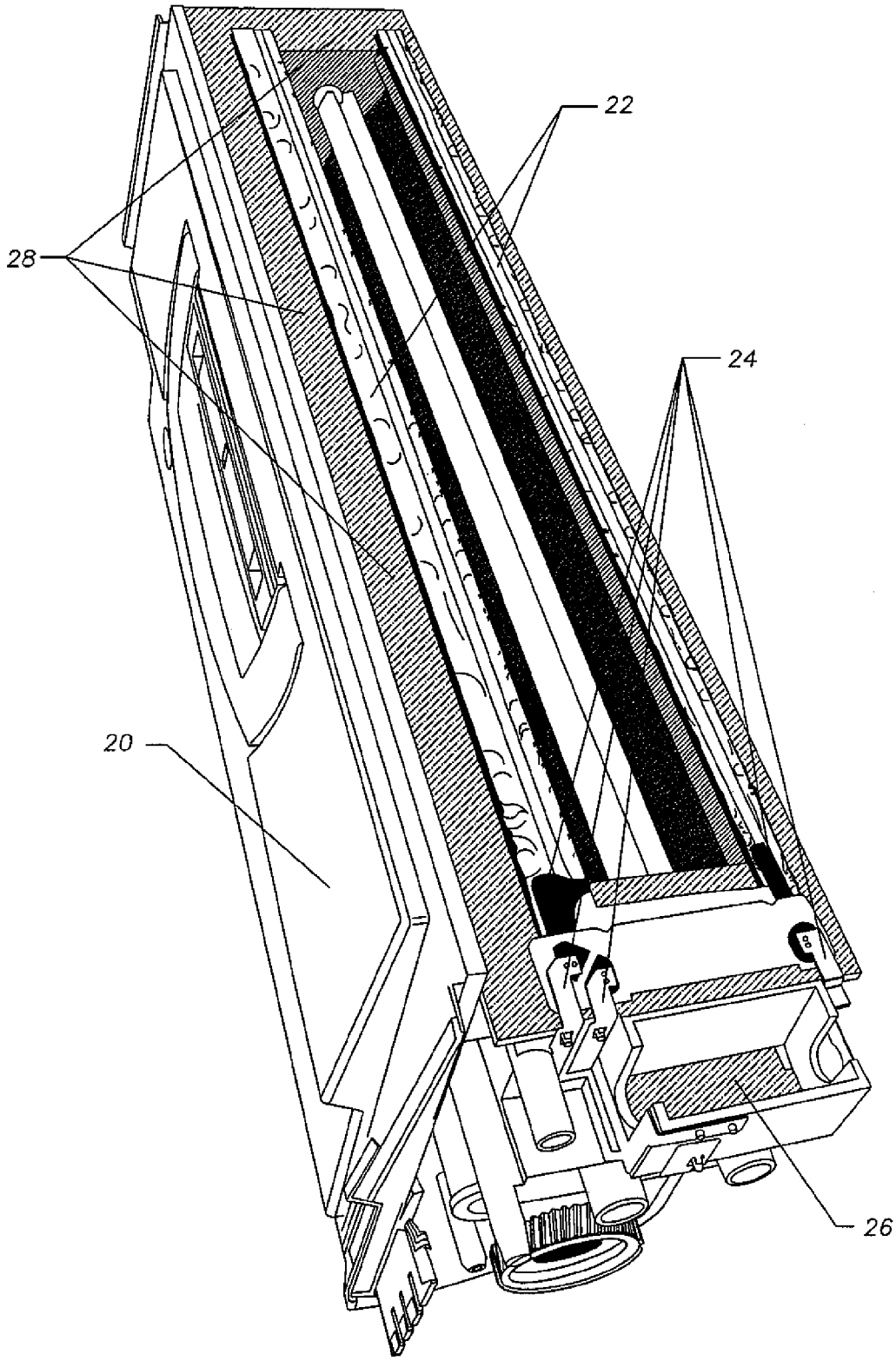
FIG. 1A is a perspective view of a prior spent laser printer toner cartridge showing the remains of the original conductive strips.
Figure 1B:
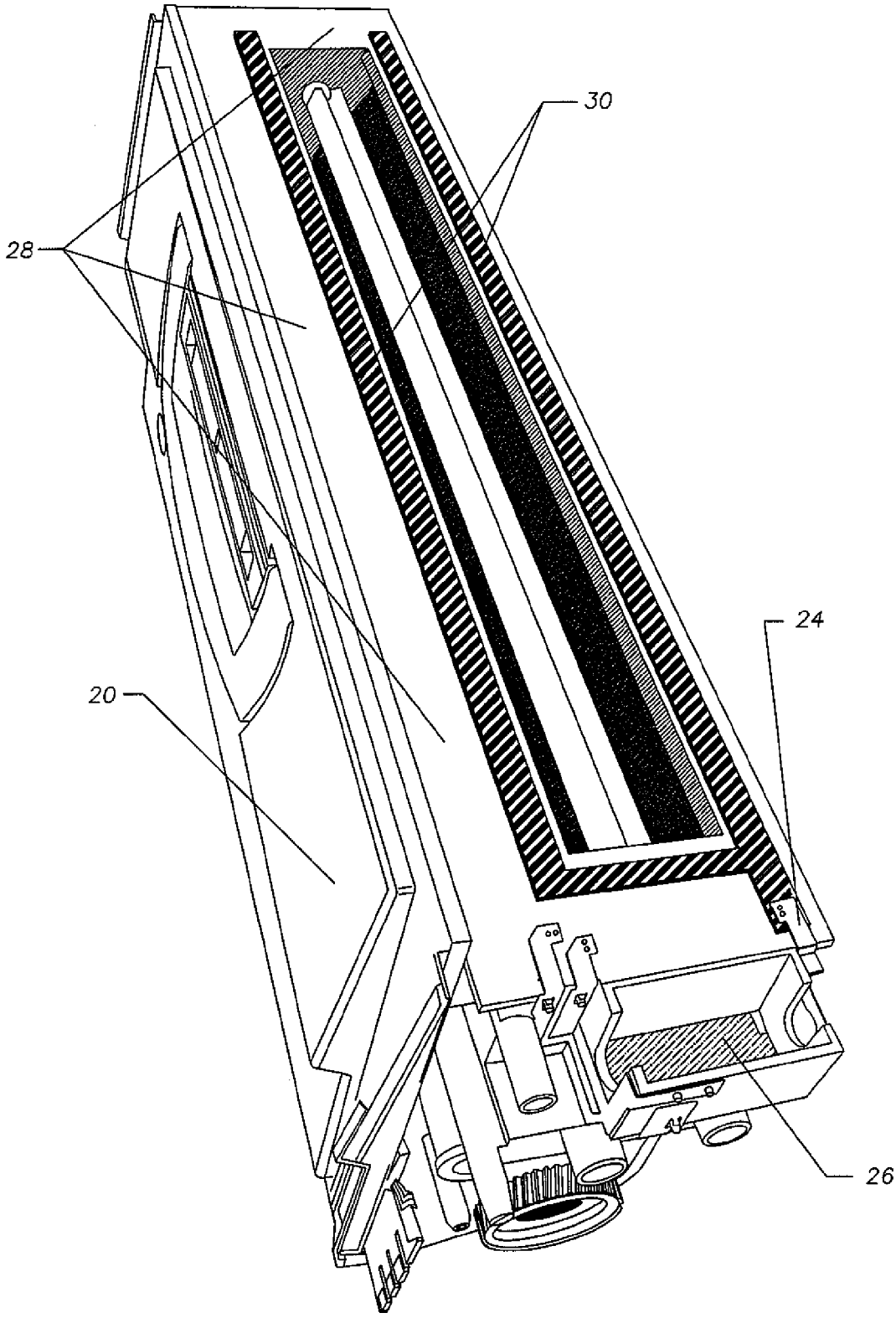
FIG. 1B is a perspective view of a spent laser printer toner cartridge with a first embodiment of a replacement electrically conductive strip on the cartridge hopper.

With reference to FIGS. 1A and 1B, a laser printer toner cartridge tank or hopper (20) shows the remnants (22) of the OEM conductive strip that are preferably left in place on the cartridge hopper. As also shown in FIG. 1A these remnant strips are loosely attached. An adhesive backed foam seal, shown in FIG. 4, covers the loose OEM conductive strips, in order to seal the toner tank from leaking while being shipped or while being operated inside the printer. In order for a repaired or remanufactured cartridge to work optimally the OEM conductive strips preferably left in place when remanufacturing. For cartridges that do not have the OEM conductive strips, shown for example in FIG. 1B, or for cartridges in which the strips are damaged, a replacement conductive strip (30) is used to replace the OEM strip(s) or otherwise be a substitute for a missing conductive strip. The OEM electrical contacts and contact strip material are shown at (24). During operation of the original OEM cartridge, after the OEM hopper pull seal is pulled into the housing, shown at (26), these electrical contacts communicate with the printer and provide the status of the toner in the hopper. Specifically, the status of the amount of toner remaining, and eventually when the cartridge is empty, is communicated via signals passing through these electrical contacts. During initial operation and upon activation the seal strip is wound into the housing at the location shown at (26). During repair or remanufacture, the remnant OEM conductive strips and replacement or substitute strips, if any, are adhered to the flat surface (28). When installing a replacement or substituted electrically conductive contact strip, it is placed under the existing contact tab (24). Tab (24) then provides the contact by which signals can be communicated to the printer regarding the status of the amount of toner remaining inside the cartridge.

FIG. 1B shows a laser printer toner cartridge at the same angle as shown in FIG. 1A, but without any remnants of the OEM electrically conductive strip, which has been removed. In such a circumstance, a replacement or substituted electrically conductive contact strip (30) is provided on the cartridge, as shown, and is then used in the repair or remanufacture of the cartridge. As shown in FIG. 1B, it is preferable to use only a single contact (24). The end of the contact is place under the contact tab to maintain electrical continuity. As may be appreciated two contact tabs may be used.

Figure 2:
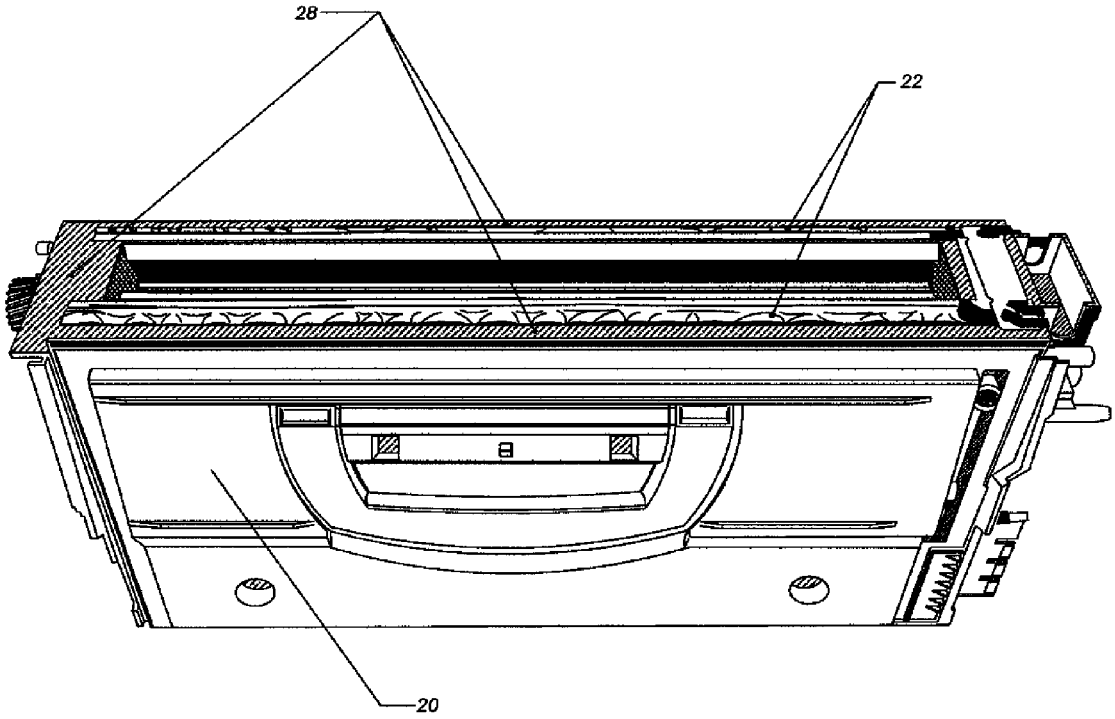
FIG. 2 is a front horizontal view showing a prior art cartridge in which the OEM electrically conductive strips and the electrical contacts are shown
Figure 4:
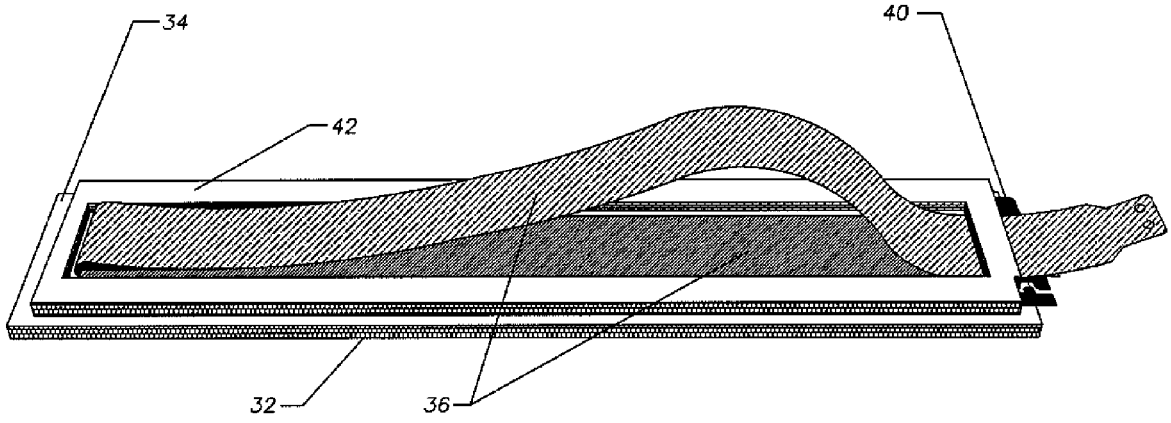
FIG. 4 is a perspective, horizontal view of an embodiment of an assembled seal assembly of the present invention.

FIG. 2 is a horizontal perspective view of a prior art plastic laser toner cartridge (20) showing that the OEM electrically conductive strips (22) are loosely attached to the face (28) of the toner cartridge. This loose attachment is one reason why an adhesive-backed foam seal assembly (32), shown in FIG. 4 is used in the repair or remanufacture of this type of cartridge. This assembly (32) enables the cartridge face (28) to be sealed to the conductive strips to prevent leakage during both transport and operation in the printer for the life of the cartridge.

Figure 3A:
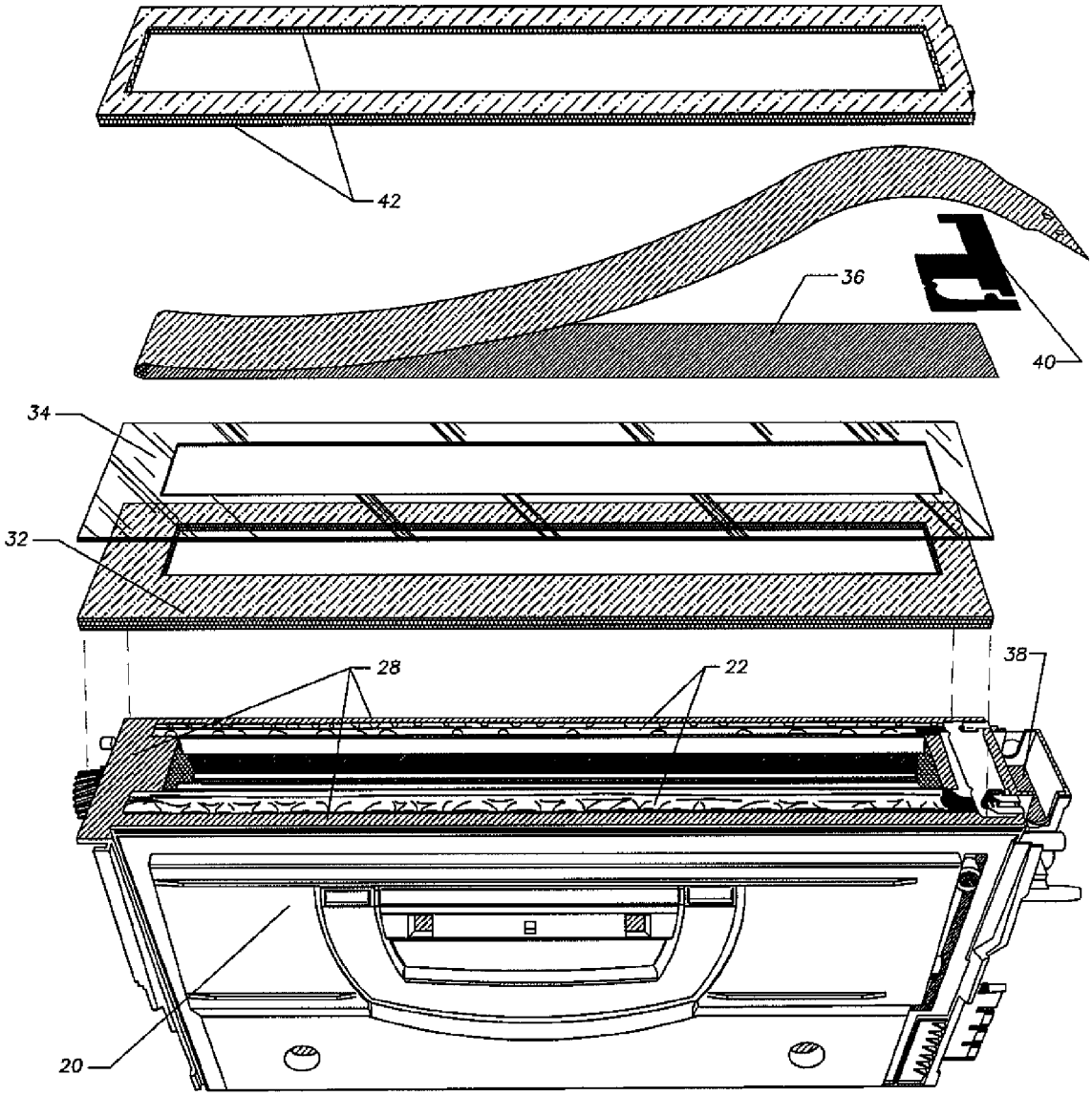
FIG. 3A is an exploded, perspective assembly view of an alternate embodiment of the cartridge seal assembly.

FIG. 3A is a horizontal perspective view of a plastic laser toner cartridge and with an exploded, perspective assembly view of an embodiment of the present toner hopper pull seal strip assembly. In this embodiment the laser toner cartridge (20) includes remnants of the OEM electrically conductive strips (22) left in place on the face (28) of the toner hopper. These remnants allows for electrical signals from the toner cartridge to be communicated to the printer for proper operation of the printer and to allow for monitoring of the toner level in the cartridge. This communication also functions to allow the printer to be able to shut off if and when the toner cartridge is empty, i.e., when the toner has been consumed.

Again referring to FIG. 3A, the bottom adhesive-backed foam (32) is adhered to the surface (28) directly over the remnants of the two OEM strips (22), thus sealing the top face of the toner hopper tank during both shipping and operation. Lower adhesive-backed foam (32) is also attached to a piece of 10 mil thick sheet of acrylic material (34) that has been cut to have a rectangular opening in the center to permit flow of toner therethrough. The acrylic strip functions as a surface to which the strip (36) adheres. Also, preferably, toner hopper seal strip (36) is heat sealed to the acrylic sheet. When the toner cartridge is placed into the printer, the toner hopper seal strip (36) is automatically pulled and rolled into a compartment section of the cartridge, shown at (38). The toner hopper seal is broken as the seal is pulled off and out of the toner hopper area to expose the tone hopper tank. The toner can then be used to print pages. After the toner hopper pull seal strip (36) has been removed or rolled away from the toner hopper face, the printer is ready to use the toner cartridge and print.

As also shown in FIG. 3A, electrical contact strip, or plate (40) is positioned across one end of the cartridge and at a stationary part of the strip (36). When the strip (36) is pulled, it rips or tears the contact (40), and activates the printer functions. As the toner hopper seal strip (36) is being pulled into the side compartment on the cartridge at (38), it will tear the electrical contact strip (40), and when electrical continuity of the strip has been broken through tearing, the printer functions will be activated. The electrical contact strip (40) also provides for communication with the remnants of the OEM strips (22). This communication enables the repaired or remanufactured cartridge the ability to communicate to the printer the amount of toner that is left in the toner cartridge, and to shut down the printer when the toner has been exhausted. The toner hopper pull seal strip (36) also functions to seal the toner hopper tank (20) when the laser toner cartridge is being shipped. The top foam-backed adhesive strip (42) has a rectangular opening in the center and attaches to the magnetic roller housing to the toner cartridge hopper tank. The assembly is thus sealed to the magnetic housing so as to not allow toner to leak from this area during cartridge operation and well as during shipping. For clarity the conventional magnetic roller housing is not shown.

Figure 3B:
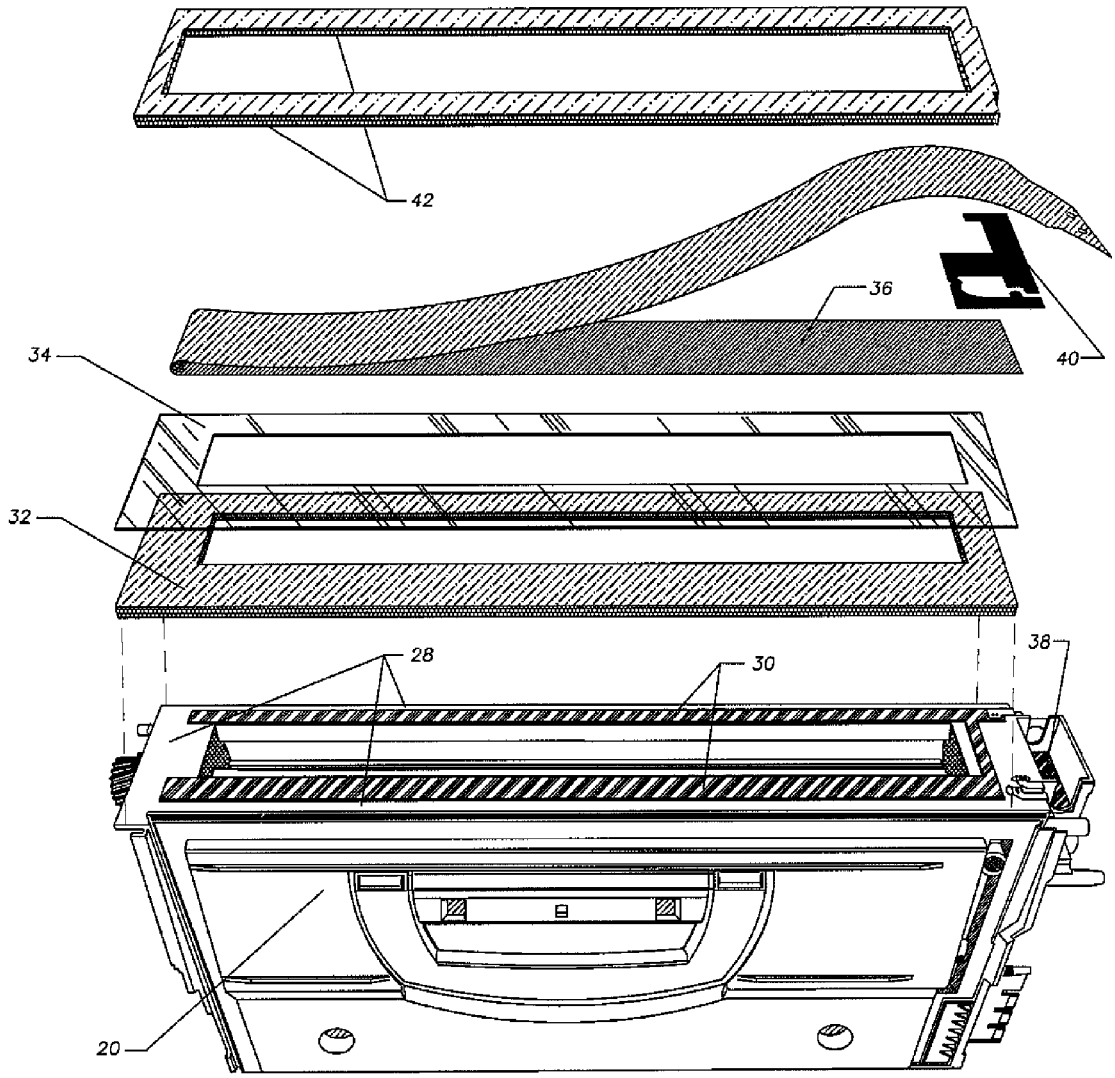
FIG. 3B is an exploded, perspective assembly view of an alternate embodiment of the cartridge seal assembly.

FIG. 3B shows the same structures as has been previously described with respect to FIG. 3A, but in FIG. 3B a replacement or substitute electrically conductive contact strip (30) is shown to replace the OEM strips that were either damaged or missing. The strip (30) functions as do the OEM electrically conductive strips in regard to communication of electrical signals to the printer for toner loading and stoppage of the printer when the cartridge toner is depleted. The strips 30 are commercially available from HISCO, 1395. Manassero Street, Anaheim, Calif. 92807, (714) 777-2661. The bottom adhesive-backed foam (32) is shown to fit directly on top of the replacement contact (30) and functions to prevent any toner from leaking during the shipping process, just as the foam does when it is placed directly over the remnant OEM strips.

FIG. 4 shows a preferred embodiment of the present assembled toner hopper seal assembly, illustrating how the toner hopper pull seal strip (36) would seal the toner hopper during shipping or in a static position. The assembly functions to seal the toner hopper tank face of the spent cartridge even though some of the original OEM pull seal assembly remnants are left in place on the cartridge. This seal will keep toner from leaking out of the cartridge. When pressure is applied to the foam, it will seal the OEM conductive strips against the hopper face to prevent leakage. The assembly also functions to seal the cartridge against leakage during shipping of the repaired cartridge. The foam backed adhesives, both top (42), and bottom (32), seal the toner hopper tank to the magnetic roller housing, thus eliminating any toner leakage during the printer operation. The electrical communication strip (40) functions to communicate, in combination with the remnants of OEM strips, the status of the toner cartridge in relation to the amount of toner in the cartridge hopper. An open center, 10 mil thick acrylic strip (34) to which the pull seal (36) is heat-sealed, is also shown in this view. Once the printer is activated by turning on the power, the printer will automatically pull the toner hopper pull seal 36 and roll it up into a cavity in the toner cartridge that has been designed to house the seal.

Figure 5:
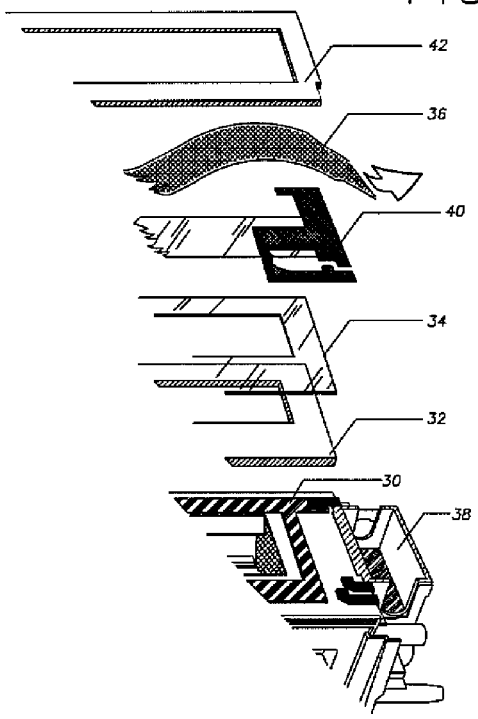
FIG. 5 is partial, end assembly view showing components of an intact contact plate alternate embodiment of the present invention, which components will fit over a replacement electrical continuity strip as presently described.
Figure 6:
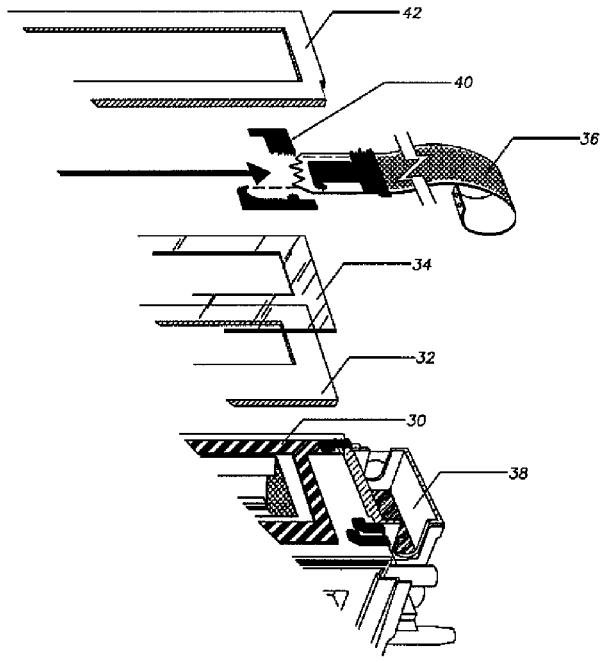
FIG. 6 is a partial, end assembly view showing the FIG. 5 embodiment contact plate after it has been broken through pulling of the pull seal.

FIGS. 5 and 6 illustrative tearing of the electrically communicative contact strip (40) and activation of the printer. The contact strip or plate (40) is preferably made of aluminum that is 3 mil thick and is flexible. FIG. 5 shows the intact plate (40) prior to pulling the seal. FIG. 6 shows the plate (40) after the seal has been pulled and it has been torn, so that electrical continuity has been broken. Once the toner hopper pull seal strip (36) is pulled out of the cartridge (20), the contact strip (40) is torn as shown in FIG. 6, thus breaking the electrical path from the bottom end of the strip (40) to the top end of the strip. The removal of the center of the contact strip and breaking of the electrical continuity, as illustrated, activates the printer. As will be appreciated, the embodiments in which remnant electrically conductive strips or replacement electrically conductive strips may be used. Essentially no difference in the way the communicative contact strip is torn results in the embodiments in which remnant conductive strips or replacement conductive strips are used. Also, it has been discovered that the electrically communicative remnant contact strip serves no useful purpose when used in conjunction with a replacement or substitute electrically conductive contact strip. The assembled toner hopper seal assembly as shown in FIG. 4 can be used for both applications, i.e., with remnant OEM conductive strips, or with the replacement conductive strips.

Figure 7:
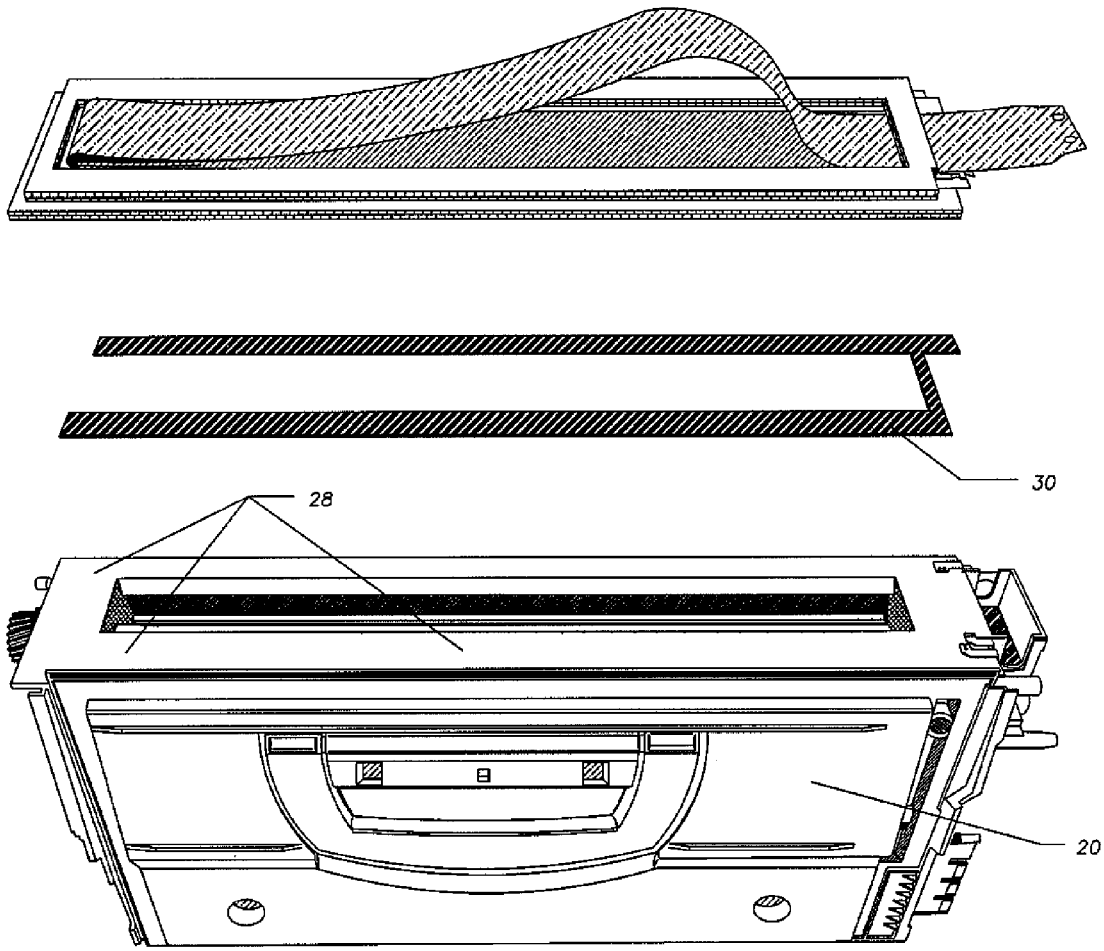
FIG. 7 is a horizontal view of a cartridge and an exploded, perspective view of an alternate embodiment of the presently disclosed electrically conductive strip assembly.

FIG. 7 is an exploded, horizontal perspective view of the cartridge (20) and the replacement or ancillary contact strip (30), and the orientation of these components. During repair or remanufacture, the toner hopper seal assembly would be made. Then the assembly would be applied, in a fully assembled configuration, as shown, directly over the ancillary or replacement electrically conductive contact strip (30), and onto the toner hopper face (28). This is done to prevent any toner leakage during operation from with-in the printer as well as when the toner cartridge is shipped.

Figure 8A:
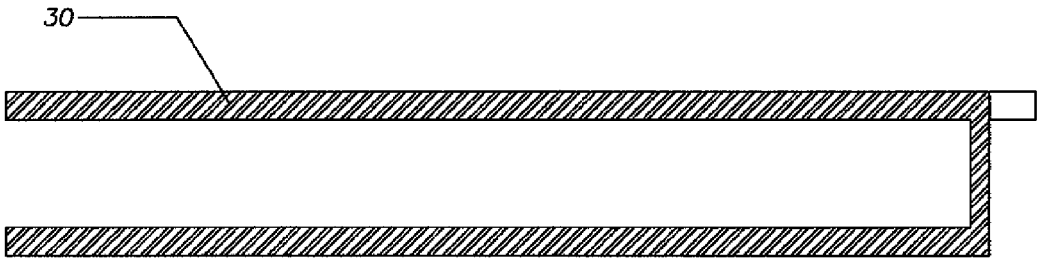
FIGS. 8A and 8B are top and perspective views, respectively, of the electrically conductive strip of the FIG. 7 embodiment; and, FIGS. 9A and 9B are exploded, perspective and side assembly view drawings of the components of the FIG. 7 embodiment.
Figure 8B:
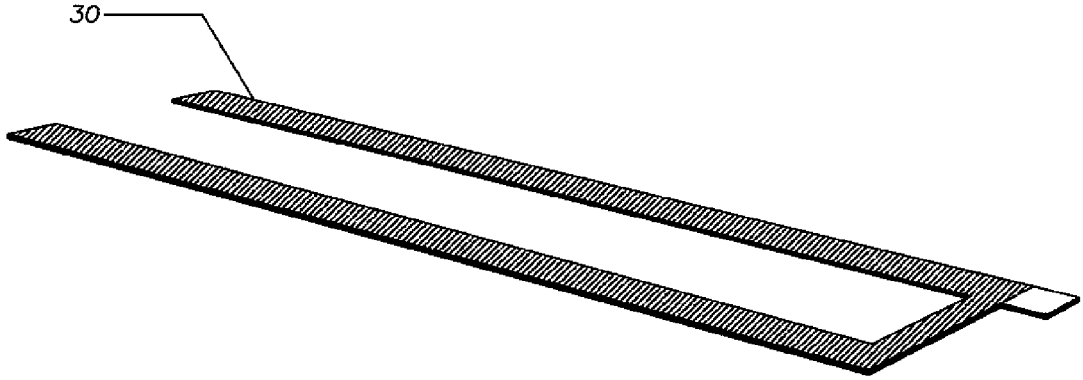

FIGS. 8A and 8B show the assembled ancillary or replacement electrically conductive contact strip (30) by itself in both a top view and in a perspective view.

Figure 9A:
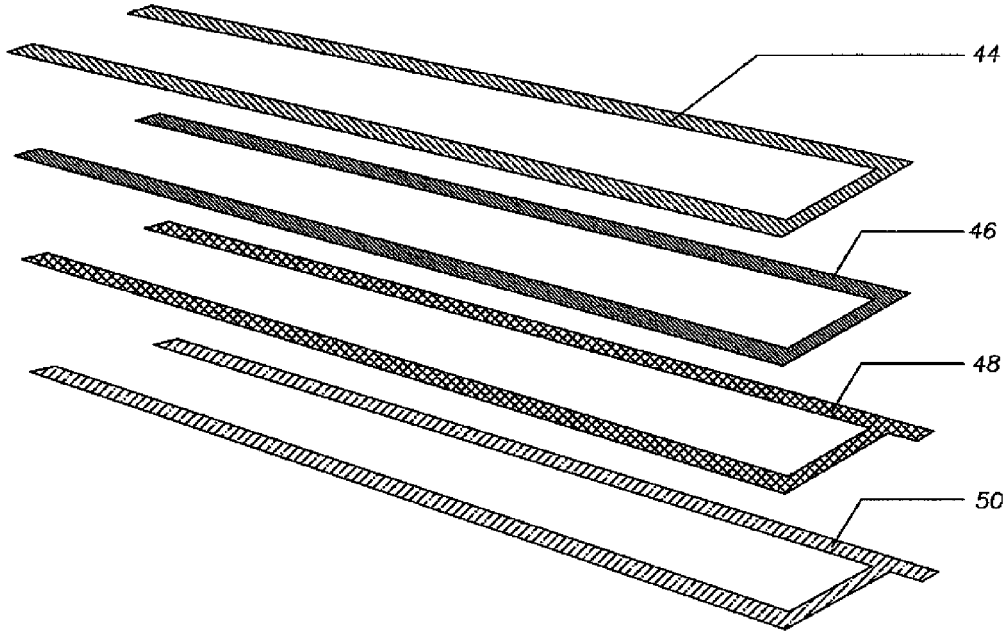
Figure 9B:
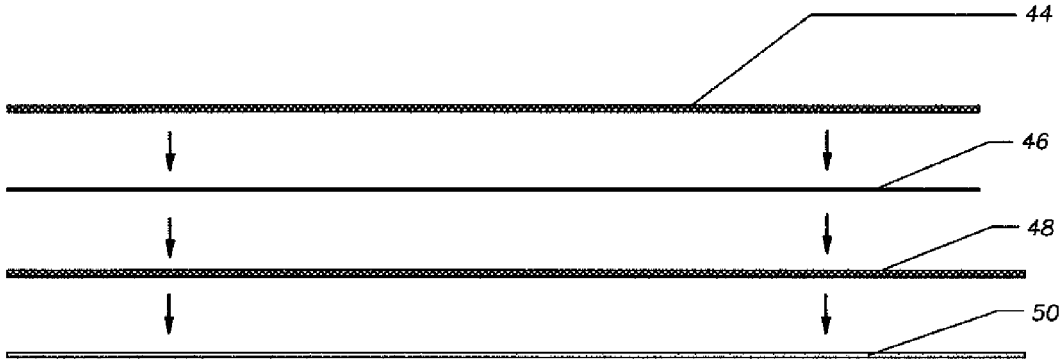

FIGS. 9A and 9B include two views of the ancillary or replacement electrically conductive contact strip assembly. Upper layer (44) preferably is 0.004 mil thick black Mylar brand polyester sheet, or a sheet of material that provide the same functions and are therefor considered to be equivalent to the Mylar brand sheet. The layer (46) below the 0.004 mil polyester layer (44) preferably is a 0.001 mil thick, conventional, double-sided adhesive strip (46), for example 3M brand 9447 adhesive strip. Alternatively, 3M brand 9495 LE adhesive strips, as well as conventional aluminum tape are also useful for this purpose. The preferred conductive contact material, the next layer (48), is commercially available MACtac brand BP1000 material, or an equivalent material that will function to provide the same results. MACtac is a wholly-owned subsidiary of American Bemis Company, Inc., and is a manufacturer of pressure sensitive tapes. The last layer (50) is a release liner that is pulled off before attaching the ancillary contact strip to the toner hopper tank face (28), as shown in FIGS. 1A, 1B, 2, 3A, 38 and 7.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A remanufactured laser printer toner cartridge comprising:

a previously used laser printer toner cartridge magnetic roller section;

a previously used laser printer toner cartridge hopper section having a top face, electrical contacts positioned on the top face, a central opening, a first central opening end and a second central opening end;

remnants of electrically conductive strips positioned on the cartridge hopper section and in electrical communication with the electrical contacts positioned on the top face;

a seal assembly positioned on the cartridge hopper section and over the remnants of electrically conductive strips;

the seal assembly comprising;

a first adhesive-backed foam seal having a central opening, an outer peripheral region conforming in shape to the top face of the hopper section, adhered to the top face of the hopper section and positioned over the remnants of electrically conductive strips;

a piece of acrylic sheet having an opening in the center, having an out periphery conforming in shape to the top face of the hopper section and adhered to the adhesive-backed foam seal;

a rectangular shaped, flexible strip having a first fold section that extends from the first central opening end and over the central opening to the second central opening, and having a second fold section that extends from the second central opening end and over the central opening back to the first central opening end;

the flexible strip extending over the piece of acrylic sheet; and, a second adhesively backed foam seal having a central opening, an outer peripheral region conforming in shape to the top face of the hopper section and adhered to the toner cartridge magnetic roller section.

2. A remanufactured laser printer toner cartridge comprising:

a previously used laser printer toner cartridge magnetic roller section;

a previously used laser printer toner cartridge hopper section having a top face, electrical contacts positioned on the top face, a central opening, a first central opening end and a second central opening end;

two electrically conductive strips positioned on the cartridge hopper section, extending along two sides of the central opening from the first central opening end to the second central opening end, joined together at the first central opening end and in electrical communication with the electrical contacts positioned on the top face;

a seal assembly positioned on the cartridge hopper section and over the remnants of electrically conductive strips;

the seal assembly comprising;

a first adhesive-backed foam seal having a central opening, an outer peripheral region conforming in shape to the top face of the hopper section, adhered to the top face of the hopper section and positioned over the electrically conductive strips;

a piece of acrylic sheet having an opening in the center, having an out periphery conforming in shape to the top face of the hopper section and adhered to the adhesive-backed foam seal;

a rectangular shaped, flexible strip having a first fold section that extends from the first central opening end and over the central opening to the second central opening, and having a second fold section that extends from the second central opening end and over the central opening back to the first central opening end;

the flexible strip extending over the piece of acrylic sheet; and, a second adhesively backed foam seal having a central opening, an outer peripheral region conforming in shape to the top face of the hopper section and adhered to the toner cartridge magnetic roller section.

3. In a remanufactured laser printer toner cartridge including a previously used laser printer toner cartridge hopper section having a top face, two electrical contacts positioned on the top face, a central opening, a first central opening end and a second central opening end, the improvement comprising:

an electrically conductive strip assembly including a first layer of a polyester material, a second layer of an adhesive material, and a third layer of an electrically conductive material;

the electrically conductive strip assembly positioned on the top face of the hopper section around the periphery of the central opening;

the assembly including a first electrically conductive strip extending along one side of the central opening from the first central opening end to the second central opening end, a second electrically conductive strip extending along a second side of the central opening from the first central opening end to the second central opening end, the first strip and the second strip joined together at the first central opening end and in electrical communication with one of the electrical contacts positioned on the top face of the cartridge hopper section.

* * * * *